US010301129B2

(12) United States Patent
Urrutia Nebreda et al.

(10) Patent No.: US 10,301,129 B2
(45) Date of Patent: May 28, 2019

(54) PRINT MEDIUM BUFFERING

(71) Applicant: HEWLETT-PACKARD DEVELOPMENT COMPANY, L.P., Houston, TX (US)

(72) Inventors: Martin Urrutia Nebreda, Barcelona (ES); Marta Ramis Llinares, Sant Cugat del Valles (ES); Eduardo Martin Orue, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/310,194

(22) PCT Filed: May 28, 2014

(86) PCT No.: PCT/EP2014/061192
§ 371 (c)(1),
(2) Date: Nov. 10, 2016

(87) PCT Pub. No.: WO2015/180782
PCT Pub. Date: Dec. 3, 2015

(65) Prior Publication Data

US 2017/0158445 A1 Jun. 8, 2017

(51) Int. Cl.
*B65H 5/36* (2006.01)
*B65H 5/06* (2006.01)
(Continued)

(52) U.S. Cl.
CPC ..... *B65H 5/36* (2013.01); *B65H 5/062* (2013.01); *B65H 9/08* (2013.01); *B41F 25/00* (2013.01);
(Continued)

(58) Field of Classification Search
CPC ..... B65H 5/36; B65H 5/068; B65H 9/004; B65H 2404/63; B65H 2404/62; B65H 2301/51212; B41F 25/00
See application file for complete search history.

(56) References Cited

U.S. PATENT DOCUMENTS 4,262,895 A * 4/1981 Wenthe, Jr. ..... B65H 15/00 271/184
5,482,389 A 1/1996 Bickoff et al.
(Continued)

FOREIGN PATENT DOCUMENTS

CN 1440917 9/2003
CN 1443649 9/2003
(Continued)

OTHER PUBLICATIONS

Shandon New Beiyang Information Technology Co., Ltd. User's Manual. Embedded Printer.

*Primary Examiner* — Patrick Cicchino
(74) *Attorney, Agent, or Firm* — HP Inc. Patent Department

(57) ABSTRACT

The present disclosure discloses print-medium buffering systems that have a set of print-medium-buffer flags (25) which, in one position, maintain a print medium in a guided path (G) as it passes through a print-medium buffer zone. A drive mechanism (30) is provided to move the set of print-medium-buffer flags away from the guided path, to a second position.

13 Claims, 6 Drawing Sheets

(51) Int. Cl.
*B65H 9/08* (2006.01)
*B41F 25/00* (2006.01)

(52) U.S. Cl.
CPC ..... *B65H 2301/51212* (2013.01); *B65H 2404/62* (2013.01); *B65H 2404/63* (2013.01)

(56) References Cited

U.S. PATENT DOCUMENTS

| | | | | |
|---|---|---|---|---|
| 5,692,744 | A | 12/1997 | Funato | |
| 6,105,957 | A * | 8/2000 | Miller | B65H 9/004 271/188 |
| 6,240,260 | B1 | 5/2001 | Krupica et al. | |
| 6,826,374 | B2 | 11/2004 | Kato et al. | |
| 6,974,128 | B2 | 12/2005 | Quesnel | |
| 7,314,075 | B2 | 1/2008 | Takagi et al. | |
| 8,109,507 | B2 * | 2/2012 | Okumura | B65H 9/006 271/227 |
| 8,348,261 | B2 * | 1/2013 | Moriyama | B65H 3/44 271/186 |
| 8,585,047 | B2 * | 11/2013 | Sato | B65H 5/36 271/234 |
| 8,646,774 | B2 * | 2/2014 | Yoshinaga | B65H 85/00 271/225 |
| 9,193,546 | B2 * | 11/2015 | Nakamura | B65H 5/062 |
| 2004/0251613 | A1 * | 12/2004 | Quesnel | B65H 5/36 271/243 |
| 2011/0266742 | A1 | 11/2011 | Sato | |
| 2013/0292899 | A1 | 11/2013 | Mattern et al. | |

FOREIGN PATENT DOCUMENTS

| | | | | |
|---|---|---|---|---|
| EP | 1791030 | A1 * | 5/2007 | B65H 5/36 |
| JP | 07309476 | | 11/1995 | |
| JP | 2002207259 | | 7/2002 | |
| JP | 2002207259 | A * | 7/2002 | |

* cited by examiner

T1

T2

PRINT MEDIUM BUFFERING

BACKGROUND

The present disclosure relates to print-medium buffering systems, as well as to methods of such print-medium buffering systems. The print-medium buffering systems may be provided in printers.

Print-medium buffering systems are provided to compensate for timing differences, such as lags and leads, that can arise when a print medium is transported between zones in an apparatus, for example in a printer.

For instance, in various printers (especially in printers designed for the high-volume production market) the print medium is supplied on a roll and is fed as a web into a cutting region where the web is cut into sheets, and the transport of the web is temporarily halted while the cutting process takes place. In some such printers, a print-medium buffer zone is provided after the cutting region and portions of the print medium accumulate in the print-medium buffer zone, temporarily, so that media sheets can be fed continuously into a subsequent printing region.

DETAILED DESCRIPTION

There are benefits to increasing the speed of transport of print-media through devices such as printing devices. An example of such a printing device is a high-volume print production printer. However, when there is an increase in the throughput of a printer which has a print-medium buffer zone then, generally, there is a corresponding increase in the quantity of print-medium that accumulates in the print-medium buffer zone.

In a typical print-medium buffering system, a set of generally finger-shaped elements, called flags, are provided to keep the print medium running along a guided path as the print medium passes through the print-medium buffer. When the rate of advance of the print medium out of the print-medium buffer zone is slower than the rate of supply of print medium into the print-buffer zone, the print medium accumulates in the print-medium buffer zone. The print medium will tend to bulge or curve away from the guided path by a progressively-increasing amount as more excess print medium builds up in the print-medium buffer zone. When the feed-out rate of the print medium from the buffer zone increases relative to the feed-in rate, the print-medium portion in the print-medium buffer zone gradually flattens down again.

When the quantity of print-medium accumulating in the print-medium buffer zone increases, this can lead to problems.

Firstly, the print-medium buffering flags that maintain the print-medium travelling along the desired path rest against the surface of the print medium and, although the flags are mounted to allow them to rotate, they tend to slide relative to the print-medium surface as the print-medium bows away from the guided path and later flattens down again. This sliding tends to increase plot damage on the print medium.

Secondly, when the amount of print medium accumulating in the print-buffer zone increases this can lead to problems when feeding certain materials. For example, when a large amount of a non-rigid print medium, such as natural tracing paper (NTP) for example, accumulates in a print-medium buffer, the flexibility of the material is such that the print medium tends to deform in an unstable way (e.g. it may fold) and this can cause feeding problems such as paper jams.

Below, examples of certain print-medium buffering systems will be described in applications where they are integrated, in a high-volume printer, at a location between a print-medium cutting zone and a printing zone. However, it is to be understood that the print-medium buffering systems of these examples may be integrated at other locations within printers (e.g. at the input/output of different zones in the printer), and indeed in different kinds of devices that handle media (e.g. in printers and other devices using media provided in the form of sheets instead of on rolls).

Figure 1:
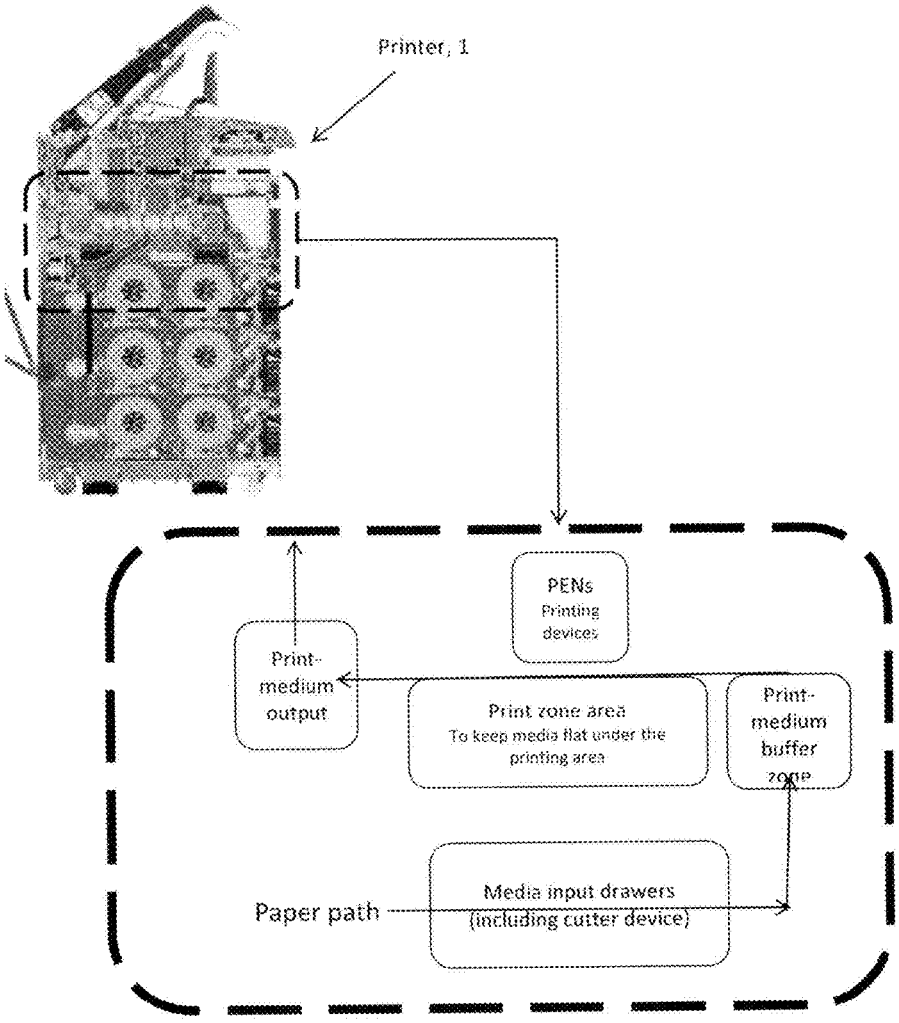
FIG. 1 is an example of a printer in which a print-medium buffering system may be integrated.

FIG. 1 illustrates an example of a printer in which a print-medium buffering system may be integrated. FIG. 1 shows a cross-section of the overall printer structure and an enlarged diagram illustrating the environment where a print-medium buffering system may be located according to this example.

In the example printer of FIG. 1 the print medium is supplied in the form of a continuous web wound in a roll. The print medium is fed from a medium input drawer (housing the relevant roll) to a cutter device which cuts a sheet from the web. The cut sheet is then advanced into a print-medium buffer zone where a print-medium buffering system guides the print-medium sheet into the subsequent zone (here, a print zone) with any necessary buffering of the print-medium sheet. The print-medium sheet is advanced through the print zone where the printing devices perform a printing process on the print medium, and then the sheet is output towards an output tray.

FIGS. 2A to 2C and FIGS. 3A to 3C illustrate how a print-medium accumulates in a print-medium buffer when a print-medium buffering system 10 according to a comparative example is used in the printer of FIG. 1.

Figure 2A:
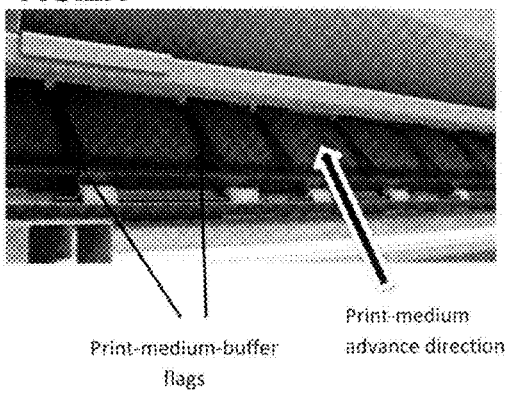
FIGS. 2A to 2C show a sequence of photographs illustrating how a print medium accumulates in a print-medium buffer zone of a printer according to FIG. 1 using a print-medium buffering system according to a comparative example.
Figure 3A:
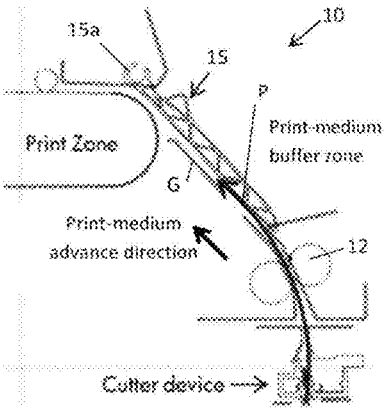
FIGS. 3A to 3C show a sequence of diagrams corresponding to the photographs of FIGS. 2A to 2C.

As seen in FIG. 2A and FIG. 3A, according to this comparative example a sheet of print medium P is fed into the print-medium buffer zone by rollers 12. A set of print-medium-buffer flags 15 are provided to guide the print-medium sheet P along a guided path G into the print zone. In this example the guided path G is along a support surface. The print-medium-buffer flags 15 are elongate, generally finger-shaped elements each having one end 15*a* mounted, independently of the others, to a shaft (not shown) extending in the widthwise direction (i.e. in the direction transverse to the direction of print-medium advance). Each flag 15 is mounted so that it can pivot around the mounting shaft. The other end of each print-medium-buffer flag 15 is a free end 15*b* (labelled in FIG. 3C).

Figure 2B:
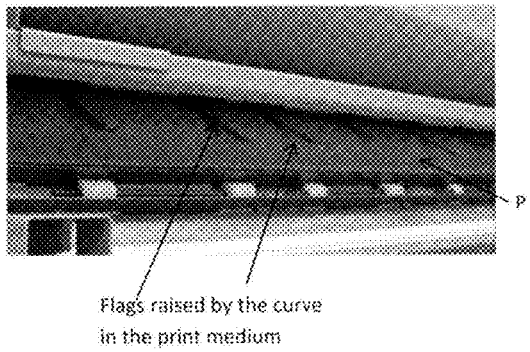
Figure 3B:
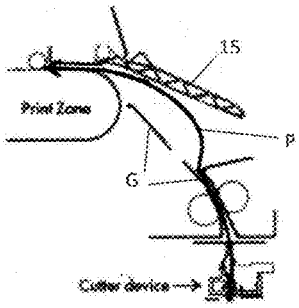

FIG. 2B and FIG. 3B illustrate what happens as print medium starts to accumulate in the print-medium buffer zone. The sheet of print medium P begins to curve away from the guided path G and, because the flags 15 are free to rotate around the mounting shaft, the flags 15 are raised by the curve in the print medium sheet P.

Figure 2C:
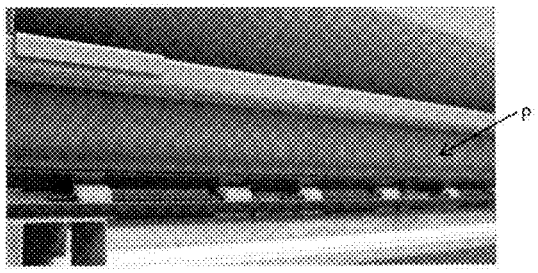
Figure 3C:
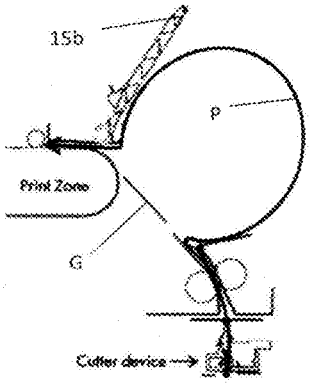

FIG. 2C and FIG. 3C illustrate what happens as the print medium accumulates to a greater degree in the print-medium buffer zone. The sheet of print medium P develops a pronounced curve and this lifts the flags 15 still further (indeed in FIG. 2C they are raised to the point where they can no longer be seen in the figure because they are masked by a housing portion).

As mentioned above, when a print-medium buffering system 10 according to this comparative example is used then problems can arise, especially when the amount of print medium accumulating in the print-medium buffer zone becomes large.

Figure 4:
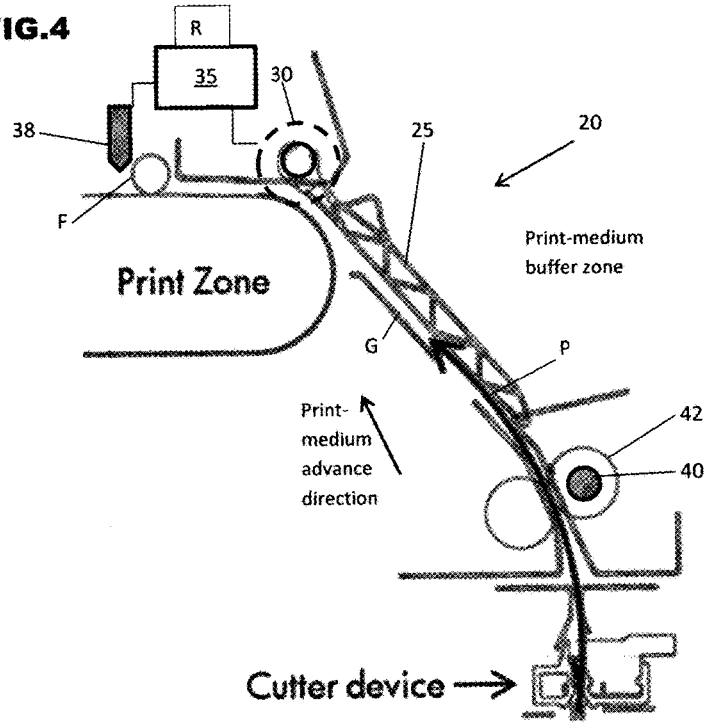
FIG. 4 is a diagram illustrating an example of a print-medium buffering system according to the present disclosure.

FIG. 4 illustrates an example of a print-medium buffering system 20 according to the present disclosure. The print-medium buffering system 20 of this example includes a set of print-medium-buffer flags 25 and a drive mechanism (indicated at 30) for moving the set of print-medium-buffer flags 25.

In the example illustrated in FIG. 4 the shape of each flag is generally finger-like, but this is not essential; other shapes may be used which guide the print medium through the buffer zone and are mounted for rotation in the appropriate direction. For example: the flag may be in the form of: a flat plate pivoted along one edge, an L-shaped element with a pivot point at the top of the L, a U-shaped element having pivot points at the top of both arms of the U, and so on.

The set of print-medium-buffer flags 25 illustrated in the figures has four flags spaced evenly in the widthwise or "cross-process" direction (i.e. in a direction transverse to the direction of advance of the print medium), but this is merely a non-limiting example. The set of print-medium buffer flags 25 may comprise one, two, or more than two flags. The spacing between the flags may be varied. In this example the flags are made of a plastics material and have a hollow lattice-work structure, to increase stiffness, but once again this is a non-limiting example and, for example, solid flags may be used. The flag weight, and the choice of material, depends on the intended application.

In this example the drive mechanism 30 that moves the set of print-medium-buffer flags 25 is controlled by a control unit 35. In particular, the control unit 35 controls the times at which the drive mechanism 30 moves the set of print-medium-buffer flags 25. The control unit 35 may receive signals (e.g. via a receiver R) from sensors, encoders and other devices that provide information that enables the control unit 35 to determine or estimate the position of the print medium. For example, a leading-edge sensor 38 may be provided to detect when the leading edge of a print medium reaches a specified position in the print zone. As another example an encoder 40 may be provided on a roller 42 that helps to feed the print medium into the print-medium buffer zone, and may provide information regarding the state of advancement of a print medium sheet P into the print-medium buffer zone. As yet another example, a trailing edge sensor (not shown) may be used to provide the control unit 35 with positional information regarding the print medium.

In the example print-medium buffering system 20 illustrated in FIG. 4, the drive mechanism 30 includes a motor 31 (illustrated in FIG. 5) to drive movement of the set of print-medium-buffer flags 25 between two positions. When the set of print-medium-buffer flags 25 are in their first position, the flags are in the lowered position illustrated in FIG. 4 and cooperate with a facing support surface to define a guide channel or guide path along which a sheet of print medium P advances as it passes through the print-medium buffer zone. Incidentally, in this example the motive force that causes the print medium sheet P to advance through the print-medium buffer zone derives, initially, from the feed rollers 42.

When the leading edge of the print medium sheet P has advanced sufficiently far into the zone that is subsequent to the print-medium buffer zone in the direction of advance of the print medium (i.e. in this example, when the leading edge of the print medium has advanced sufficiently far into the print zone) the drive mechanism 30 is operated to move the set of print-medium buffer flags 25 away from the guide path G to a second position where the flags 25 are out of contact with the print medium sheet P. Print medium can accumulate in the print-medium buffer zone while the flags 25 are in the second position and, because the flags 25 are not in contact with the print medium, damage to the medium surface is reduced. Furthermore, because the accumulating print medium is less restricted by the flags 25 when they are in the second position, there is a reduced tendency for print media made of non-rigid materials to deform in an unstable way, and this reduces feeding problems.

A printer that comprises a print-medium buffering system according to the above example has the advantage of increased versatility because it can handle a high throughput for a wide range of print media, including not only relatively rigid materials but also relatively non-rigid materials, with a reduced risk of jamming. In addition, the image quality obtained when operating at high throughput is improved, because there is reduced plot damage.

Above it is indicated that the drive mechanism 30 moves the set of print-medium-buffer flags 25 to the second position when the leading edge of the print-medium sheet P has advanced "sufficiently far" into the zone subsequent to the print-medium buffer in the transport path of the print medium. In this example, "sufficiently far" is far enough into the print zone for the leading edge of the print-medium sheet P to be able to experience traction from a feed element in the print zone (so that the print-medium sheet P may reliably advance further into the print zone). In the example of FIG. 4 the print zone includes a set of pinch wheels F which operate to feed a print medium further into the print zone. The set of pinch wheels F may include one wheel, two wheels, or more than two wheels.

In certain examples of print-medium buffering systems according to the present disclosure, the drive motor which moves the print-medium buffer flags 25 is also operative to move the set of print zone pinch wheels F to take them out of contact with a print medium passing through the print zone (e.g. so that a paper jam may be cleared).

Figure 5:
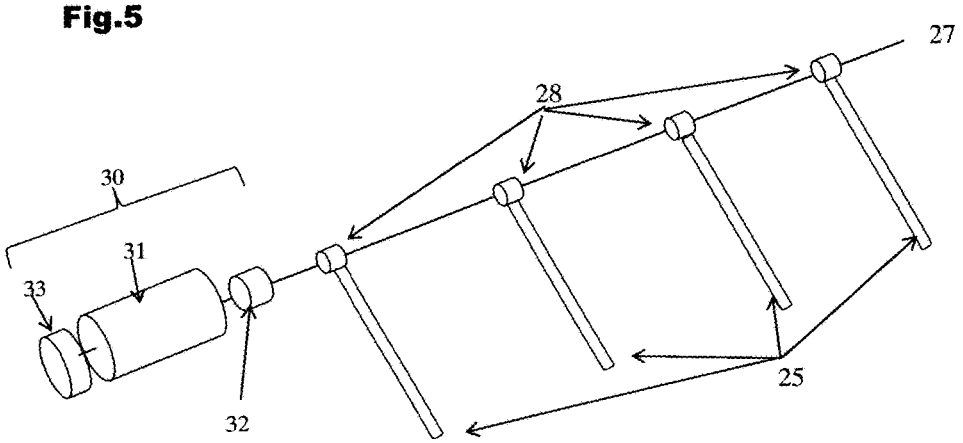
FIG. 5 is an exploded diagram illustrating an example of a drive mechanism for an example of a print-medium buffering system according to the present disclosure.

Different drive mechanisms may be used to move the print-medium-buffer flags 25. FIG. 5 illustrates an example arrangement in which the drive mechanism 30 includes a drive motor and transmission 31 arranged to rotate a shaft 27 to which the print-medium-buffer flags 25 are connected via fixings 28. In this example, all the print-medium-buffer flags 25 are mounted at the same angle relative to the shaft. The shaft 27 may have a flat surface portion enabling the drive motor to apply torque to the shaft. A homing mechanism 32 may be provided to enable the first and second positions of the flags 25/shaft 27 to be regulated, for example during initialization of the printer in which the print-medium buffering system is installed. An encoder 33 may be provided in association with the drive motor and transmission 31 to enable monitoring of the position of the shaft 27 (and, hence, the monitoring of the angular position of the flags 25).

Figure 6A:
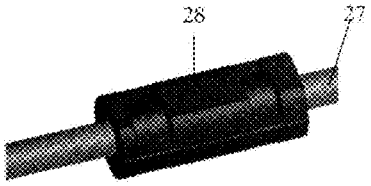
FIGS. 6A and 6B illustrate an example of an attachable arrangement for fixing print-medium-buffer flags relative to a shaft.
Figure 6B:
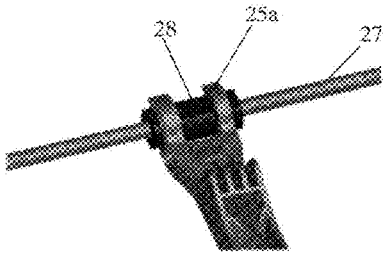

According to the present example the drive mechanism 30 moves the set of print-medium-buffer flags 25 together. This grouped movement of the flags 25 may be achieved using different arrangements. As illustrated in FIGS. 6A and 6B, in an example print-medium buffering system each of the flags 25 has one end 25*a* clipped onto a fixing 28 that is mounted on the shaft 27 at a fixed angular position relative to the shaft, and the flag clips are designed not to rotate relative to the fixings 28. Because the print-medium-buffer flags 25 are all mounted to rotate as the shaft 27 rotates they can all be moved together by driving the rotation of the shaft.

Figure 7A:
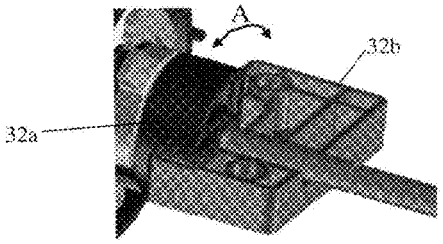
FIGS. 7A, 7B and 7C illustrate a homing mechanism for regulating the positions of a set of print-medium-buffer flags.
Figure 7B:
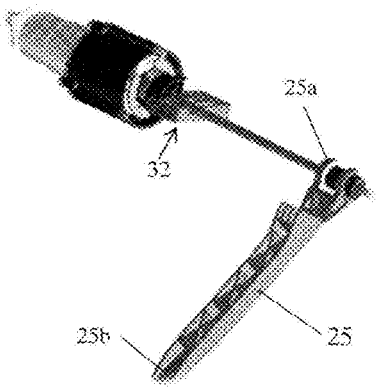
Figure 7C:
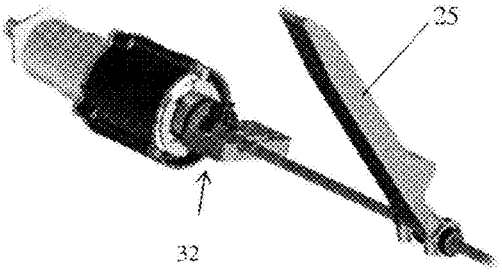

Various arrangements may be used to set the rotational angles of the shaft 27 that correspond to the first and second positions of the set of print-medium-buffer flags 25. FIGS. 7A to 7C illustrate an example implementation of a homing mechanism 32 of FIG. 5. The homing mechanism includes a drive block 32*a* that, in this example, is shaped approximately like a quarter circle and is driven by the drive motor to rotate (in the direction indicated by arrow A in FIG. 7A) and thereby rotate the shaft 27. The homing mechanism also includes a stopper block 32*b* having a rotary space in which the drive block 32*a* can rotate between two extreme positions. The extreme positions of the drive block 32*a* correspond to the first and second positions of the set of print-medium-buffer flags 25.

Thus, as illustrated in FIG. 7B, when the drive block 32*a* is moved to its extreme anti-clockwise position relative to the stopper block 32*b* the shaft is rotated to a position which moves the flags 25 to their first position (where they are operative to guide a print medium passing through the print-medium buffer zone along the guided path G). As illustrated in FIG. 7C, when the drive block 32*a* is moved to its extreme clockwise position relative to the stopper block 32*b* the shaft is rotated to a position which moves the flags 25 to their second position (where the flags are held away from the guided path G and, in general, are out of contact with the print medium accumulating in the print-medium buffer zone: there may be some minor contact between the raised flags and the accumulated print medium at the time when the maximum amount of print medium is accumulated in the buffer).

Figure 8A:
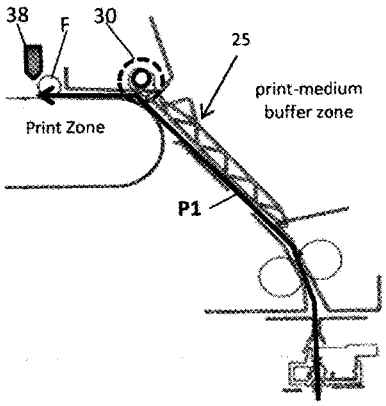
FIGS. 8A and 8B are diagrams illustrating examples of timings for changing the positions of a set of print-medium-buffer flags.
Figure 8B:
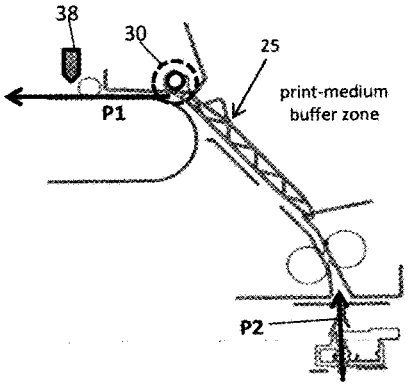

FIGS. 8A and 8B illustrate an example of timings at which the control unit 35 may control the drive mechanism to move the flags 25 between their first and second positions.

FIG. 8A illustrates an example of a time T1, during passage of a print medium sheet P1 though a print-medium buffer zone, when the drive mechanism 30 is controlled to move the print-medium-buffer flags 25 from their first position to their second position. At this time T1 the leading edge of the print medium P1 has reached a position where it can reliably undergo traction from a feed element in the zone subsequent to the print-medium buffer zone (i.e. in this example, traction due to operation of the pinch wheel F in the print zone). In practice this can be accomplished by setting time T1 to a moment when the leading edge of the print-medium sheet P1 has advanced a few millimeters past the pinch wheel F (the appropriate distance past the feed element depends on the traction capability of the media-advance system in this zone).

In the present example, as the pinch wheel F (or other feed element) advances the leading edge of the print medium through the print zone (or other zone subsequent to the print-medium buffer zone), the feed rollers 42 that feed the print medium into the buffer zone accelerate and print medium accumulates in the buffer zone. In this way, when the feed rollers 42 stop advancing the print medium, to allow the printer's cutting element to cut off a sheet, material from the buffer can still be fed into the print zone, thus enabling continuous feeding of print medium through the print zone.

FIG. 8B illustrates an example of a time T2, as print medium sheet P1 just clears the print-medium buffer zone, when the drive mechanism 30 is controlled to move the print-medium-buffer flags 25 from their second position back to their first position, where they may be operative to guide the next sheet of print medium, P2, into the print zone. At this time T2 the trailing edge of the print medium P1 has cleared the print-medium buffer zone and the subsequent sheet P2 has not yet entered the print-medium buffer zone. By setting the time T2 to a moment before the subsequent print-medium sheet P2 reaches the input of the print-medium buffer zone, the flags 25 may be in position to ensure correct guiding of the sheet P2 when it enters the print-medium buffer zone (so that its leading edge is successfully fed into the print zone).

Although, in the above example, the set of print-medium-buffer flags is driven back from the second position to the first position at the time T2, in some architectures the flags may be allowed simply to drop back to the first position at time T2, without explicit driving.

Figure 9:
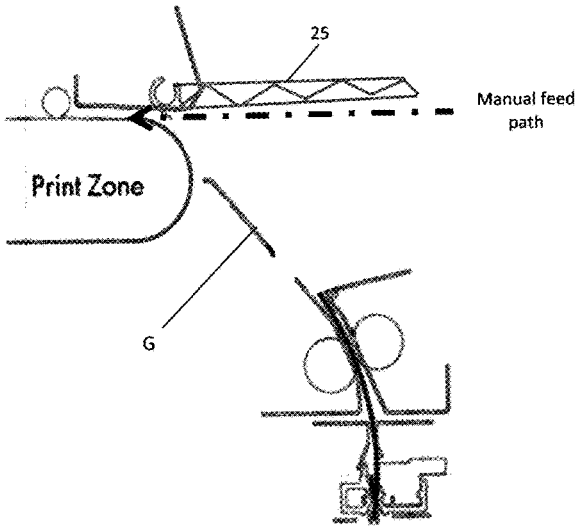
FIG. 9 is a diagram illustrating how manual feed of a print medium is accommodated in an example of a print-medium buffering system according to the present disclosure.

Print-medium buffering systems according to certain examples of the present disclosure enable print-medium sheets to be manually fed to the zone that is subsequent to the buffer zone. Systems according to these examples allow the user to control the drive mechanism 30 to move the print-medium-buffer flags 25, as a group, to a position in which they are away from the print medium path. Print media sheets can then be manually fed under the flags 25, as illustrated in FIG. 9.

Figure 10:
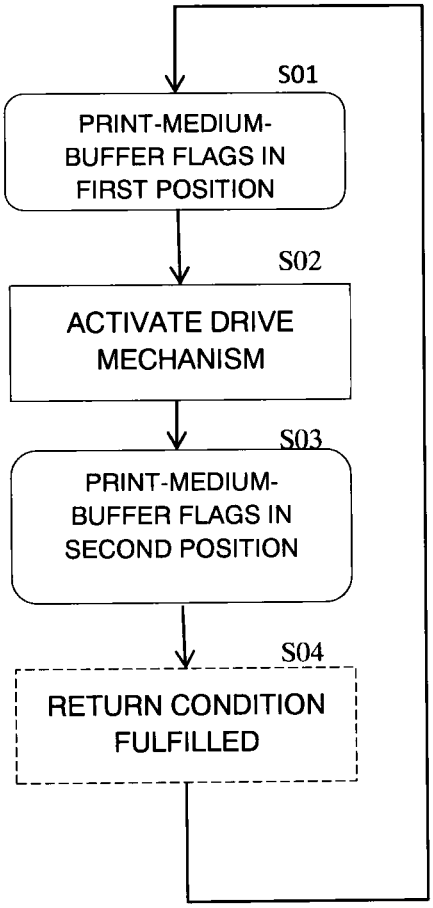
FIG. 10 is a flow diagram illustrating steps in an example method of controlling a print-medium buffering system.

FIG. 10 is a flow diagram illustrating steps in an example of a method of controlling a print-medium buffering system.

The example method illustrated in FIG. 10 includes a state S01 in which a set of print-medium-buffer flags are in a first position and are operative to maintain a print medium in a guided path passing through a print-medium buffer zone. According to the method of this example, a drive mechanism is used (in a step S02) to move the set of print-medium-buffer flags away from the guided path to a second position (state S03). The print-medium-buffer flags may be returned to the first position when a return condition is fulfilled (step S04); for example, the print-medium-buffer flags may be returned to the first position when the trailing edge of a print medium sheet has exited the print-medium buffer zone.

Various additional features may be provided in the above and other examples of methods of controlling a print-medium buffering system. For instance, in a case where on exiting the print-medium buffer zone the print medium enters a zone that has a feed element, the method may include controlling the drive mechanism to move the set of print-medium buffer flags away from the guided path at a time when the leading edge of the print medium in the print-medium buffer is engaged by the feed element. The feed element may comprise a pinch wheel, and the method may comprise using the drive motor to move the pinch wheel and to move the set of print-medium-buffer flags.

Examples of methods of controlling a print-medium buffering system according to the present disclosure may comprise controlling timing of the movement of the set of print-medium-buffer flags by the drive mechanism dependent on a detected or estimated position of the leading edge of the print medium and/or dependent on a position signal generated by an encoder (e.g. an encoder provided on a second feed element that is at the input zone of the print-medium buffer to feed print media into the print-medium buffer).

Examples of methods of controlling a print-medium buffering system according to the present disclosure may be applied in cases where the set of print-medium-buffer flags comprises at least one finger element having a mounted end and a free end, and the moving of the set of print-medium-buffer flags may then comprise causing at least one finger element to rotate around its mounted end, to move the free end of the finger element towards and away from the guided path of the print medium.

Various modifications and extensions can be made of the examples described above. For instance, although the example illustrated in FIGS. 8A and 8B relates to a print-medium buffering system whose buffer zone is located adjacent the input of a zone that contains a pinch wheel, and the position of the print medium relative to the pinch wheel affects the timing of moving the print-medium-buffer flags to their second position, it is not essential for the feed element to be a pinch wheel; other feed elements may be used (e.g. conveyor belts, rollers, and so on). In a similar way, the examples show feed rollers advancing a print medium into the print-medium buffer zone, but feeding elements different from or additional to feed rollers may be used and, indeed, any convenient feeding arrangement may be used to advance the print medium through the buffer zone.

The invention claimed is:

1. A system, comprising:

a set of print-medium-buffer flags operable, in a first position, to maintain a print medium in a guided path as the print medium passes through a print-medium buffer zone;

a print zone downstream of the print-medium buffer zone;

a cutter device upstream of the print-medium buffer zone;

a first feed element to input the print medium from the buffer zone to the print zone;

a second feed element to output print medium from the cutter device to the buffer zone;

an encoder to generate a position signal indicative of a position of a leading edge of the print medium; and a drive mechanism to move the set of print-medium-buffer flags away from the guided path to a second position based on the position signal from the encoder, wherein the first feed element comprises a pinch wheel, and the drive mechanism of the print-medium buffering system comprises a drive motor arranged to move the pinch wheel and to move the set of print-medium-buffer flags.

2. The print-medium buffering system according to claim 1, further comprising a control unit to control the drive mechanism to move the set of print-medium-buffer flags.

3. The print-medium buffering system according to claim 2, wherein the control unit is synchronized to control the drive mechanism to move the set of print-medium buffer flags away from the guided path at a time when the leading edge of a print medium in the print-medium buffer is engaged by the first feed element.

4. The print-medium buffering system according to claim 3, wherein the control unit comprises a sensor to detect the position of the leading edge of the print medium.

5. The print-medium buffering system according to claim 3, wherein the control unit comprises a receiver to receive the position signal from the encoder.

6. The print-medium buffering system according to claim 1, wherein the set of print-medium-buffer flags comprises at least one finger element having a mounted end and a free end, wherein the finger element is mounted to rotate around the mounted end, under the action of the drive mechanism, to move the free end of the finger element towards and away from the guided path.

7. A printer comprising a print-medium buffering system according to claim 1.

8. A method comprising:

operating a first feed element to feed a print medium from a buffer zone to a print zone;

operating a second feed element to feed the print medium from a cutter device to the buffer zone;

generating a position signal from an encoder, the position signal indicative of a position of a leading edge of the print medium; and moving a set of print-medium-buffer flags away from a first position forming a guided path to a second position, using a drive mechanism, based on the position signal from the encoder, wherein the first feed element comprises a pinch wheel, and the method comprises using the drive mechanism to move the pinch wheel and to move the set of print-medium-buffer flags.

9. The method according to claim 8, the method further comprising:

controlling the drive mechanism to move the set of print-medium buffer flags away from the guided path at a time when the leading edge of the print medium in the print-medium buffer is engaged by the first feed element.

10. The method according to claim 9, further comprising controlling timing of the movement of the set of print-medium-buffer flags by the drive mechanism dependent on a position of the leading edge of the print medium.

11. The method according to claim 8, wherein the set of print-medium-buffer flags comprises at least one finger element having a mounted end and a free end, and wherein moving of the set of print-medium-buffer flags comprises causing at least one finger element to rotate around the mounted end thereof, to move the free end of the finger element towards and away from the guided path of the print medium.

12. The print-medium buffering system according to claim 1, wherein the encoder is provided on the second feed element, and the second feed element is to feed print medium into the print-medium buffer zone.

13. The method according to claim 8, wherein the encoder is provided on the second feed element, and the second feed element is to feed print medium into the buffer zone.

* * * * *